US007877837B2

(12) United States Patent
Gammack et al.

(10) Patent No.: US 7,877,837 B2
(45) Date of Patent: Feb. 1, 2011

(54) CLEANING APPLIANCE INCLUDING A TELESCOPIC WAND ASSEMBLY RETAINER

(75) Inventors: Peter David Gammack, Bath (GB); James Dyson, Dodington (GB); Matthew James Roger Allard, Bath (GB); Emma Jane Heatley, Westonbirt (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 632 days.

(21) Appl. No.: 10/526,678

(22) PCT Filed: Aug. 21, 2003

(86) PCT No.: PCT/GB03/03659

§ 371 (c)(1),
(2), (4) Date: Sep. 16, 2005

(87) PCT Pub. No.: WO2004/023963

PCT Pub. Date: Mar. 25, 2004

(65) Prior Publication Data

US 2006/0085943 A1 Apr. 27, 2006

(30) Foreign Application Priority Data

Sep. 14, 2002 (GB) ..... 0221346.0

(51) Int. Cl.
*A47L 9/00* (2006.01)

(52) U.S. Cl. ..... 15/323; 15/414

(58) Field of Classification Search ..... 15/323, 15/353, 414, 327.5
See application file for complete search history.

(56) References Cited

U.S. PATENT DOCUMENTS

| | | | |
|---|---|---|---|
| 883,413 | A | 3/1908 | Mahony |
| 942,490 | A | 12/1909 | Dunn |
| 2,337,364 | A | 12/1943 | Ashbaugh |
| 2,534,122 | A | 12/1950 | Hamala |
| 2,660,457 | A | 11/1953 | Mallon |

(Continued)

FOREIGN PATENT DOCUMENTS

| | | | |
|---|---|---|---|
| DE | 6752338 | U | 5/1968 |

(Continued)

OTHER PUBLICATIONS

European Search Report dated Apr. 4, 2005, directed to a related foreign application EP03021875; 3 pages.

(Continued)

*Primary Examiner*—Lee D Wilson
(74) *Attorney, Agent, or Firm*—Morrison & Foerster LLP

(57) ABSTRACT

A cleaning appliance of the cylinder type includes a main body and a hose and wand assembly including a telescopic wand movable between retracted and extended positions and a flexible hose having a first end connected to the main body and a second end connected to the wand. The wand and the main body include a retainer for releasable attaching the wand to the main body when the wand is in the retracted state and the hose passes around the main body. Alternatively, the wand and the main body include a retainer for releasably attaching the wand to an upper surface of the main body when the wand is in the retracted state. This construction provides a compact storage solution.

34 Claims, 13 Drawing Sheets

U.S. PATENT DOCUMENTS

| | | | | |
|---|---|---|---|---|
| 2,984,852 | A | 5/1961 | George | |
| 3,030,650 | A | 4/1962 | Kiraly | |
| 3,083,041 | A | 3/1963 | Owenmark | |
| 3,153,252 | A | 10/1964 | Ricciardi | |
| 3,170,185 | A | 2/1965 | Segesman | |
| 3,200,432 | A | 8/1965 | Voegeli et al. | |
| 3,244,437 | A * | 4/1966 | Belicka et al. | 285/7 |
| 3,407,424 | A | 10/1968 | Lanzarone et al. | |
| 3,480,987 | A | 12/1969 | Schaefer | |
| 3,510,904 | A | 5/1970 | Lagerstrom | |
| 3,651,536 | A | 3/1972 | Bolzan, Jr. et al. | |
| 3,866,257 | A | 2/1975 | Cansdale, Sr. | |
| 3,977,037 | A * | 8/1976 | Miyake et al. | 15/315 |
| 4,135,274 | A | 1/1979 | Freeman | |
| 4,325,157 | A | 4/1982 | Balint et al. | |
| 4,393,536 | A * | 7/1983 | Tapp | 15/327.5 |
| 4,563,789 | A | 1/1986 | Berfield | |
| 4,653,142 | A | 3/1987 | Upton | |
| 4,697,299 | A | 10/1987 | Brinkhoff et al. | |
| 4,864,680 | A | 9/1989 | Blasé et al. | |
| 4,910,828 | A | 3/1990 | Blasé et al. | |
| 4,955,106 | A * | 9/1990 | Stein et al. | 15/335 |
| 5,360,111 | A | 11/1994 | Arispe | |
| 5,375,938 | A | 12/1994 | Bartlow | |
| 5,462,311 | A | 10/1995 | Cipolla | |
| 5,584,436 | A | 12/1996 | Sepke | |
| 5,661,868 | A | 9/1997 | Panagakos et al. | |
| 5,742,976 | A | 4/1998 | Bensussen et al. | |
| 5,797,162 | A | 8/1998 | Vystrcil et al. | |
| 5,836,620 | A | 11/1998 | Wang et al. | |
| 5,996,170 | A | 12/1999 | Gierer et al. | |
| 6,006,399 | A | 12/1999 | Massaro | |
| 6,032,328 | A | 3/2000 | Harmon et al. | |
| D422,763 | S | 4/2000 | Tsuda | |
| 6,058,558 | A | 5/2000 | Kim | |
| 6,101,669 | A | 8/2000 | Martin et al. | |
| 6,148,474 | A * | 11/2000 | Ohara et al. | 15/377 |
| 6,154,918 | A | 12/2000 | Cain et al. | |
| 6,175,988 | B1 | 1/2001 | White et al. | |
| 6,213,672 | B1 | 4/2001 | Varga | |
| D452,594 | S | 12/2001 | Rosa | |
| 6,393,646 | B1 | 5/2002 | Beers, Jr. et al. | |
| 6,415,470 | B1 | 7/2002 | Ramrattan | |
| 6,431,607 | B1 | 8/2002 | Kittelmann et al. | |
| D462,488 | S | 9/2002 | Santiago et al. | |
| 6,461,074 | B2 | 10/2002 | Taylor | |
| D467,694 | S | 12/2002 | Kitts | |
| 6,615,442 | B2 * | 9/2003 | Yang | 15/323 |
| 6,813,806 | B2 | 11/2004 | Martinez | |
| 7,168,128 | B2 | 1/2007 | Evans | |
| D537,216 | S | 2/2007 | Davis et al. | |
| D549,406 | S | 8/2007 | Rosenzweig | |
| 7,350,267 | B2 | 4/2008 | Evans | |
| 2002/0083550 | A1 * | 7/2002 | Yang | 15/323 |
| 2002/0104184 | A1 * | 8/2002 | Rogers et al. | 15/327.5 |
| 2002/0184731 | A1 | 12/2002 | Moine et al. | |
| 2002/0189046 | A1 * | 12/2002 | Nighy | 15/327.1 |
| 2003/0145415 | A1 | 8/2003 | Fernandez-Grandizo Martinez | |
| 2005/0198764 | A1 * | 9/2005 | Heatley | 15/323 |

FOREIGN PATENT DOCUMENTS

| | | | |
|---|---|---|---|
| DE | 6752338 | | 2/1969 |
| DE | 1948941 | | 5/1970 |
| DE | 3807028 | | 9/1989 |
| DE | 29500994 | | 5/1996 |
| DE | 29816382 | | 1/1999 |
| DE | 19738329 | A1 | 3/1999 |
| DE | 19843973 | A1 | 7/1999 |
| DE | 10039186 | A1 | 2/2002 |
| EP | 0246712 | | 11/1987 |
| EP | 0893089 | | 1/1999 |
| FR | 1293812 | A | 5/1962 |
| FR | 2425227 | | 12/1979 |
| FR | 2566651 | | 1/1986 |
| GB | 337319 | | 10/1930 |
| GB | 806084 | A | 12/1958 |
| GB | 1472384 | | 5/1977 |
| GB | 2128075 | A | 4/1984 |
| GB | 2304029 | A | 3/1997 |
| GB | 2321393 | A | 7/1998 |
| JP | 47-27070 | | 11/1972 |
| JP | S48-64016 | | 9/1973 |
| JP | 57-149848 | | 9/1982 |
| JP | 57-183945 | | 11/1982 |
| JP | 3-237952 | | 10/1991 |
| JP | 6-45191 | | 6/1994 |
| JP | 8-294472 | | 11/1996 |
| JP | S63-202250 | | 12/1998 |
| JP | 11-235298 | | 8/1999 |
| JP | 2000-23887 | | 1/2000 |
| WO | WO-89/12195 | | 12/1989 |
| WO | WO-96/24000 | | 8/1996 |
| WO | WO-99/11170 | | 3/1999 |
| WO | WO-01/50940 | A1 | 7/2001 |
| WO | WO-02/071913 | A1 | 9/2002 |

OTHER PUBLICATIONS

Japanese Notice of Reasons for Rejection mailed Apr. 11, 2006, directed to Japanese Patent Application No. 2004-535626; 3 pages.
Evans, N.A., U.S. Office Action mailed Oct. 24, 2005, directed to U.S. Appl. No. 10/468,469; 8 pages.
Evans, N.A., U.S. Office Action mailed May 8, 2006, directed to U.S. Appl. No. 10/468,469; 8 pages.
Evans, N.A., U.S. Office Action mailed Jan. 23, 2007, directed to U.S. Appl. No. 10/468,469; 11 pages.
Evans, N.A., U.S. Office Action mailed Oct. 25, 2005, directed to U.S. Appl. No. 10/683,390; 10 pages.
Evans, N.A., U.S. Office Action mailed Jun. 29, 2006, directed to U.S. Appl. No. 10/683,390; 7 pages.
Heatley, E.J., U.S. Office Action mailed Sep. 11, 2008, directed to U.S. Appl. No. 10/526,668; 11 pages.
Heatley, E.J., U.S. Office Action mailed Mar. 12, 2009, directed to U.S. Appl. No. 10/526,668; 13 pages.
Heatley, E.J., U.S. Office Action mailed Jun. 18, 2009, directed to U.S. Appl. No. 10/526,668; 8 pages.
Heatley, E.J., U.S. Office Action mailed Dec. 29, 2009, directed to U.S. Appl. No. 10/526,668; 7 pages.

* cited by examiner

CLEANING APPLIANCE INCLUDING A TELESCOPIC WAND ASSEMBLY RETAINER

FIELD OF THE INVENTION

This invention relates to a cleaning appliance, such as a vacuum cleaner.

BACKGROUND OF THE INVENTION

Cleaning appliances such as vacuum cleaners are well known. The majority of vacuum cleaners are either of the 'upright' type or of the 'cylinder' type. An example of a cylinder vacuum cleaner manufactured by Dyson Limited under the name DC05 ("DC05" is a trade mark of Dyson Limited) is shown in FIG. 1.

Cylinder vacuum cleaners (called "canister" or "barrel" cleaners in some countries) generally comprise a main body 10 which contains separating apparatus 11 for separating dirt and dust from an incoming dirty airflow and for collecting the separated material. The separating apparatus is usually a filter bag or a cyclonic separator. The dirty airflow is introduced to the main body 10 via a hose and wand assembly 15, 16 which is connected to the main body 10. The main body 10 of the cleaner is dragged along by the hose 15 as a user moves around a room. A cleaning tool 20 is attached to the remote end of the wand 16. The wand 16 usually comprises a set of two, or sometimes more, telescopic tubes which can be adjusted to a length which is matched to the physical requirements of a user between a fully extended position and a fully retracted position.

It is known to provide a socket 18 on the main body of the vacuum cleaner and a hook 17 on the wand so that a user can 'park' the wand in the socket 18. When the wand is parked, it is positioned substantially vertically so that it can be readily grasped by a user. In this manner, a user does not need to bend down to retrieve the wand from the floor. A user may also choose to park the wand in this manner when the vacuum cleaner is stored. The wand can be parked in its fully retracted position for storage. Although this feature is useful, the vacuum cleaner and wand are still quite cumbersome to carry from one place to another and the cleaner is not particularly easy to store in places of limited space.

SUMMARY OF THE INVENTION

The present invention seeks to provide a cleaning appliance machine which is more convenient to store and/or to carry.

Accordingly, a first aspect of the present invention provides a cleaning appliance of the cylinder type comprising a main body and a hose and wand assembly, the hose and wand assembly comprising a telescopic wand movable between retracted and extended positions and a flexible hose having a first end connected to the main body and a second end connected to the wand, wherein the wand and the main body incorporate retaining means for releasably attaching the wand to the main body when the wand is in the retracted state and the hose passes around the main body.

This allows the machine to be more easily stored since the wand is neatly and securely stored on the main body of the machine whilst the hose is wrapped around the main body.

Preferably, the main body comprises a cyclonic separator having a collecting bin for collecting dirt and debris and the wand is releasably attachable to the collecting bin.

A second aspect of the invention provides a cleaning appliance of the cylinder type comprising a main body and a hose and wand assembly, the hose and wand assembly comprising a telescopic wand movable between retracted and extended positions and a flexible hose having a first end connected to the main body and a second end connected to the wand, wherein the wand and the main body incorporate retaining means for releasably attaching the wand to an upper surface of the main body when the wand is in the retracted state.

Preferably the main body comprises a channel for receiving the wand and retaining means are located in the channel. Where the main body comprises two generally cylindrical containers lying next to one another, the channel for receiving the wand can comprise the space between the cylindrical containers. More preferably, the channel has a sufficient depth to allow the wand to lie substantially flush with the upper surface of the main body when the wand is received in the channel.

Preferably the wand has a handle by means of which a user may lift the main body when the wand is attached thereto. More preferably, the said handle may also be used by user to manipulate the hose and wand assembly during normal use. It is convenient for the handle to extend in a direction which is substantially parallel to the longitudinal axis of the wand so as to provide a plurality of longitudinally offset positions for lifting the main body and for manipulating the wand.

It is preferred that the wand may be attached to the main body when the main body is oriented for normal use. More preferably, the main body has wheels or rollers arranged so as to allow the main body to move across a surface to be cleaned and the said wheels or rollers remain in contact with the surface when the wand is attached to the main body.

Preferably a release member for releasing the wand from the main body is also arranged to operate a locking means which locks the wand in the fully retracted position for storage. This avoids the need for a user to operate two separate controls.

Although the invention is described in detail with reference to a vacuum cleaner, it will be appreciated that it can also be applied to other forms of cleaning appliance. The term "cleaning appliance" is intended to have a broad meaning, and includes a wide range of machines having a main body and a wand for carrying fluid to or from a floor surface. It includes, inter alia, machines which only apply suction to the surface, such as vacuum cleaners (dry, wet and wet/dry variants), so as to draw material from the surface, as well as machines which apply material to the surface, such as polishing/waxing machines, pressure washing machines and shampooing machines.

BRIEF DESCRIPTION OF THE DRAWINGS

Embodiments of the invention will now be described with reference to the drawings, in which.

DETAILED DESCRIPTION OF THE INVENTION

Figure 2:
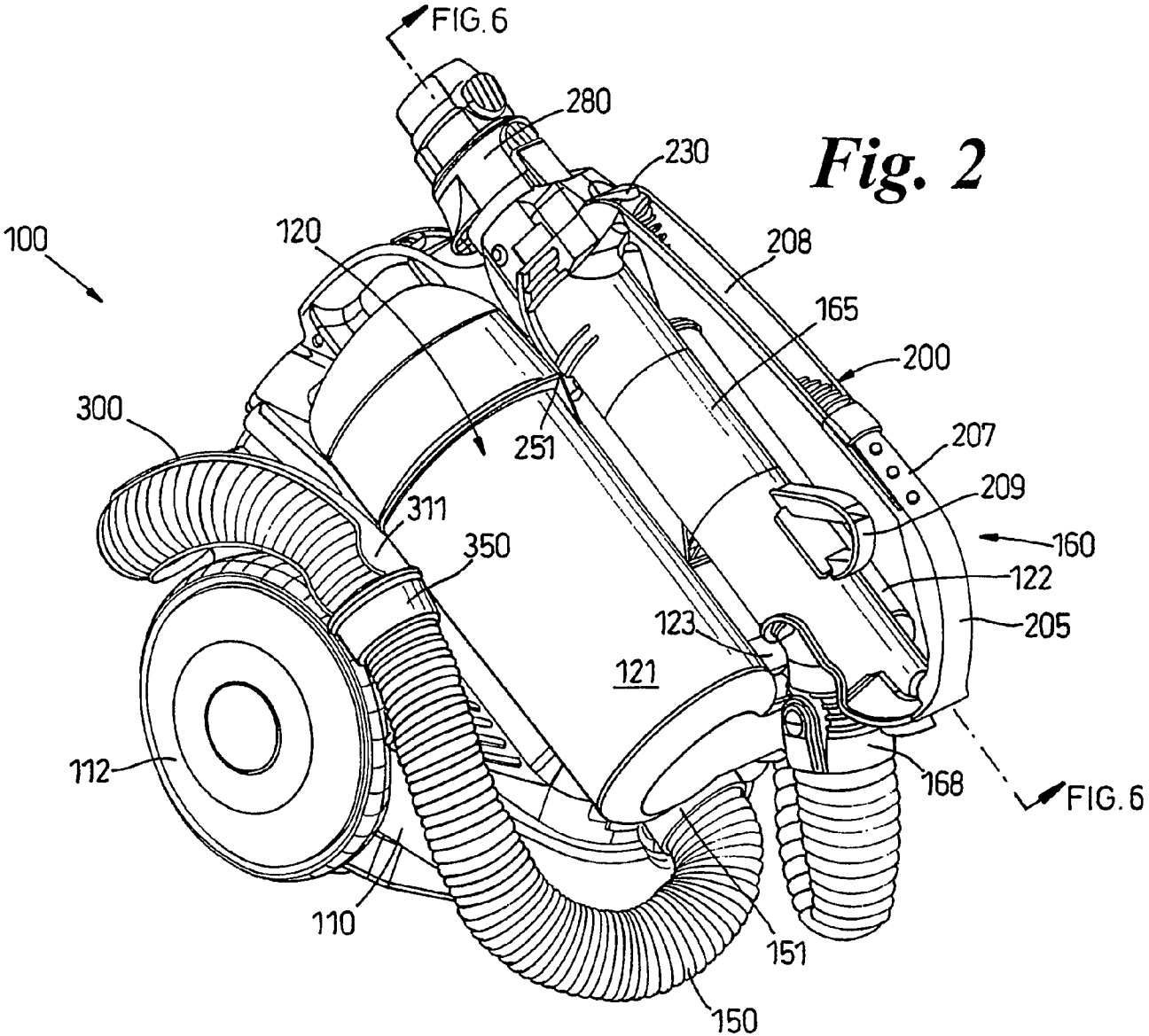
FIG. 2 shows a first embodiment of a vacuum cleaner according to the invention.

FIG. 2 shows a cleaning appliance in the form of a vacuum cleaner. The vacuum cleaner has a main body 100 which supports the main components of the vacuum cleaner. In a traditional manner, the main body 100 has a chassis 110 which supports separating and collecting apparatus 120 and a motor-driven fan (not shown) for generating a suction which can draw dirt laden air into the separating apparatus 120. The main body 100 also has two main wheels 112, one on each side of the rear portion of the chassis 110, and a castor wheel 113 beneath the front portion of the chassis 110 which allow the main body 100 to be dragged along a surface. It will be understood that the wheels 112, 113 could be supplemented, or replaced, by other means for allowing the main body 100 to be dragged across a surface, such as skids. The form of the separating apparatus 120 is not important to the invention. While we prefer to use cyclonic separators which spin dirt, dust and debris from the airflow, other forms of separator can be used and examples of suitable separator technology include a centrifugal separator, a filter bag, a porous container, an electrostatic separator or a liquid-based separator.

In FIG. 2, the separating apparatus comprises two generally cylindrical chambers 121, 122 which lie alongside one another. The chambers 121, 122 are connected to one another by a central spine 123. The separating apparatus 120 is removably mounted on the chassis for emptying and for access to components beneath the separating apparatus.

A flexible hose 150 and a wand assembly 160 connect to an inlet port 151 on the main body 100. The main body 100 of the cleaner is pulled along by the hose 150 as a user moves around a room. The hose 150 has a construction which is robust enough to withstand this pulling action, and any normal abrasion which may be encountered as the hose rubs against obstacles in a room.

In this embodiment, the air inlet port 151 is centrally mounted on the main body 100 at the forward, lower part of the machine. In alternative embodiments of the machine where the air inlet is not centrally positioned, such as the machine shown in FIG. 1 where the inlet is near the upper part of the separating apparatus 11, it is preferable to anchor the hose 150 to the machine at a central position (as with anchor point 25 in the machine shown in FIG. 1) so that when a user pulls the hose 150, the main body 100 follows the user.

Ducting on the chassis 110 connects the air inlet port 151 to an inlet to the separating apparatus 120. For a cyclonic separating apparatus 120, the inlet to the separating apparatus is arranged to guide incoming airflow through the wall of the chamber of the cyclonic separator in a tangential manner.

Figure 4:
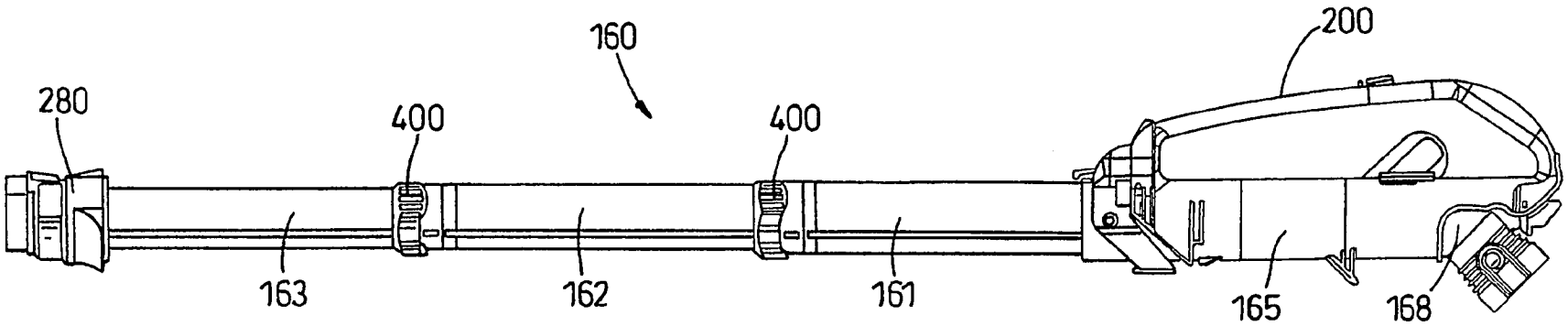
FIG. 4 shows the wand of the vacuum cleaner of FIGS. 2, 3A and 3B in an extended position.
Figure 6:
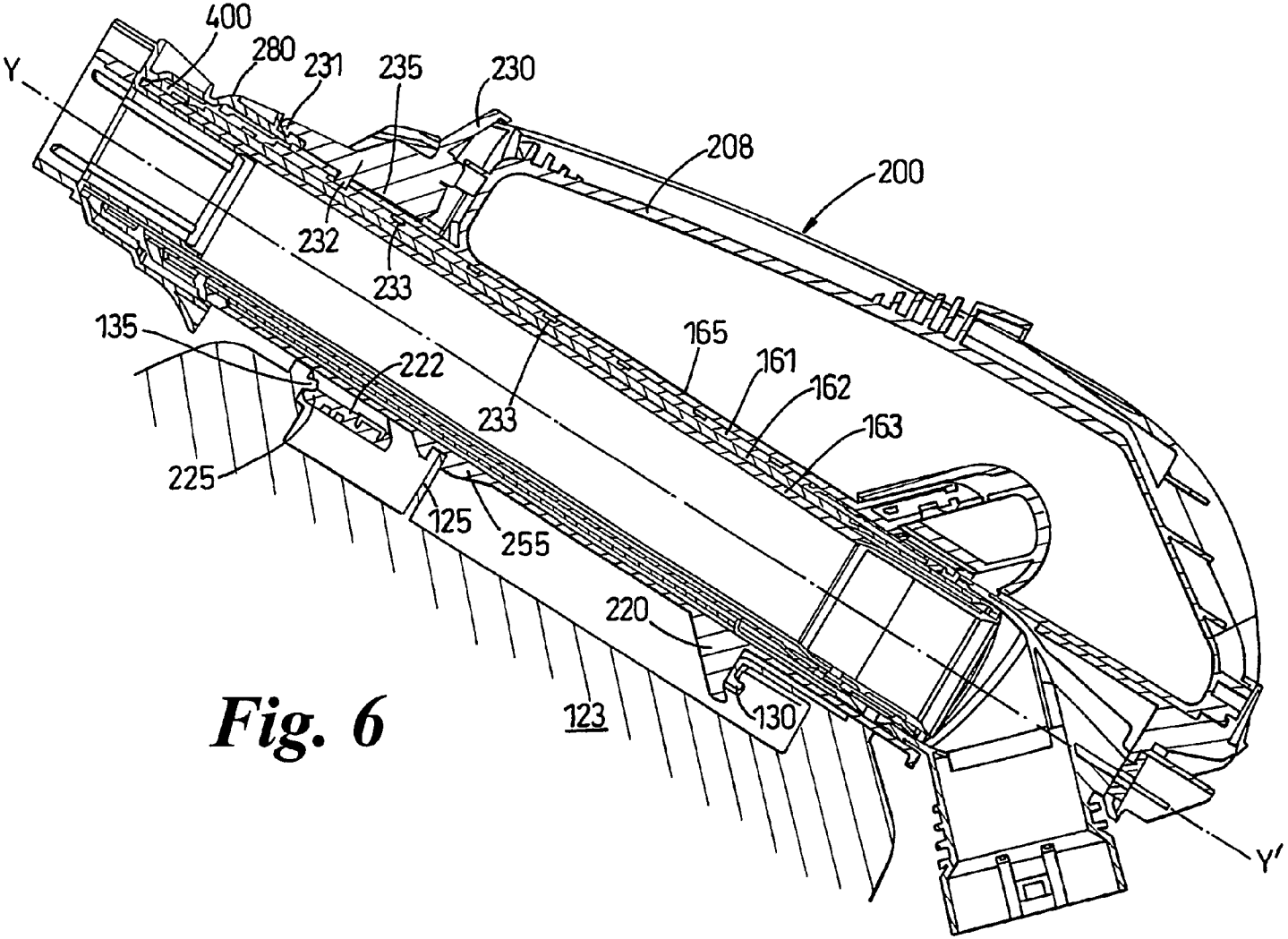
FIG. 6 is a cross-section through the wand while stored on the vacuum cleaner of FIG. 2.

The second end of the hose 150 connects to the wand 160. A suitable wand assembly 160 is described in our co-pending International Patent Application WO 02/071913. As shown in FIG. 4, the wand comprises a set of three tubes 161, 162, 163 of progressively decreasing diameter. The tubes 161, 162, 163 can telescope inside one another and are retractably housed inside a storage tube 165. The three tubes 161, 162, 163 are slideable inside one another and can be moved between a stored position (as best shown in FIG. 6) and an extended position (as shown in FIG. 4) in which one tube is extended from another such that only the ends of the tubes overlap one another. Securing mechanisms 400 secure the tubes in an extended position. The precise arrangement of the securing mechanisms does not form part of the present invention and so will not be described in any further detail here. Tubes 161, 162, 163 are progressively longer in length. The length of each tube is chosen so that it fully occupies the available space within the storage tube 165 when the securing mechanisms 400 are lying alongside one another.

Figure 1:
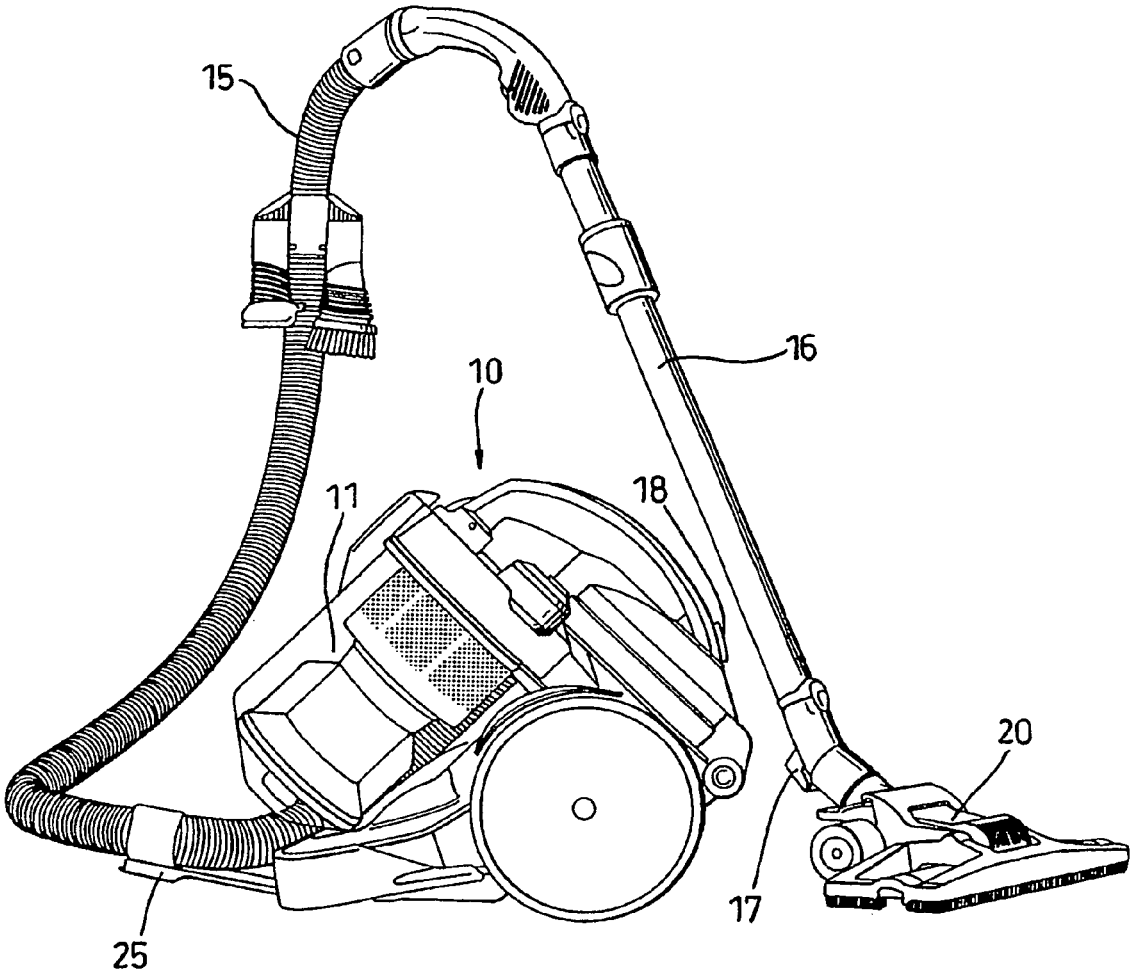
FIG. 1 shows a conventional vacuum cleaner of the cylinder type.
Figure 5:
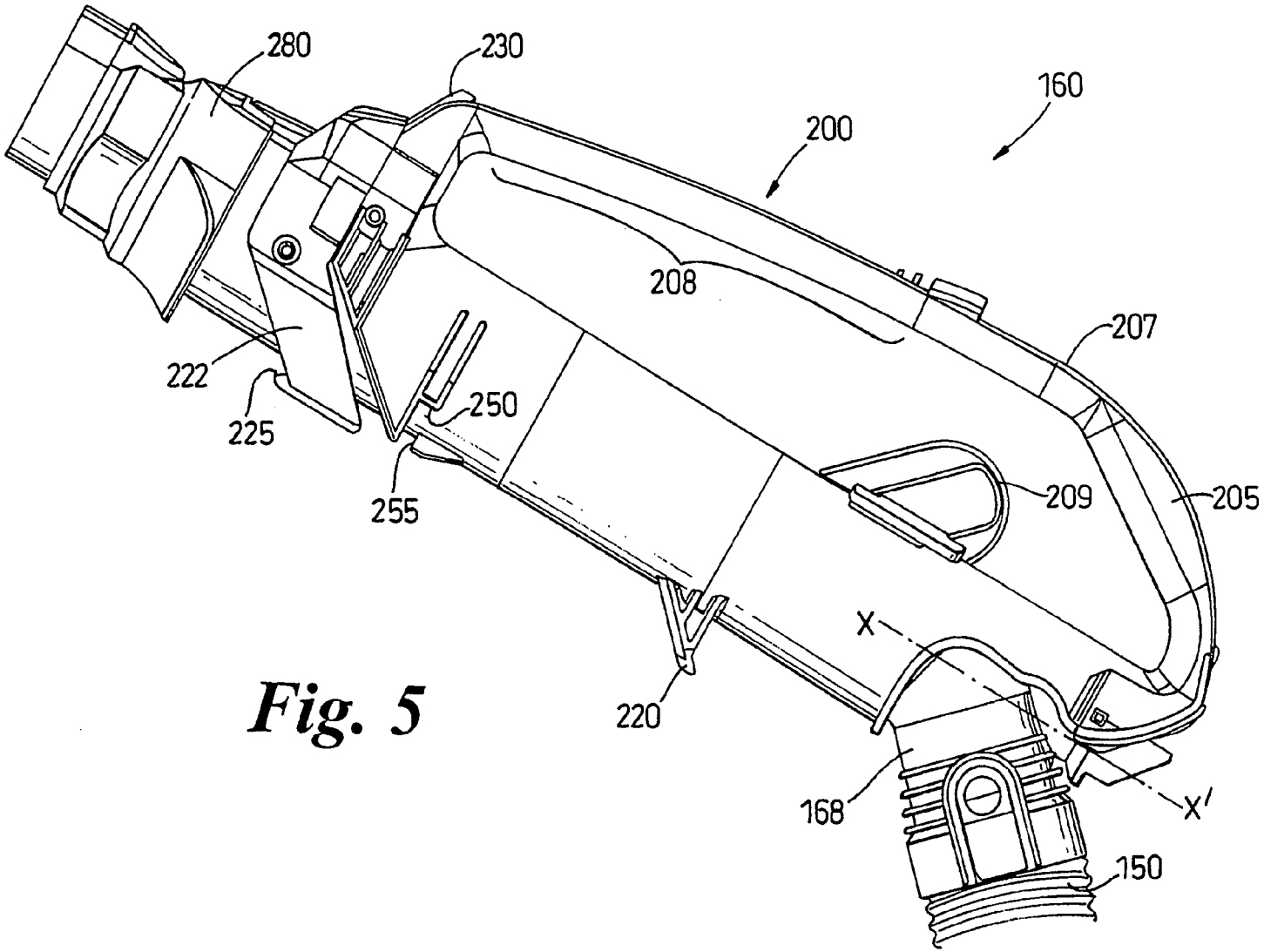
FIG. 5 shows the wand of FIG. 4 in a retracted position for storage.

The distal end of tube 163 has a connector 280 which is adapted to receive a floor tool, such as the floor tool shown 20 in FIG. 1, in any known manner. For example, the floor tool can be connected to the tube 163 by means of an interference fit, interconnecting bayonet fittings, snap-fit connections, a screw threaded collar and sleeve, or by any other suitable means. Accessory tools may also be fitted to the tube 163 in place of the floor tool. A handle 200 is located on the storage tube 165 to allow a user to manipulate the wand 160. A flexible hose 150 extends from one end of the storage tube 165 and is connected to the storage tube 165 by an outlet connector 168 which is rotatable about axis X-X', as shown in FIG. 5. This part of the wand is described more fully in our International Patent Application WO 01/50940.

For ease of storage, and ease of carrying, the wand assembly 160 can be releasably attached to the main body 100 of the vacuum cleaner, as shown in FIGS. 2 and 3.

Figure 3A:
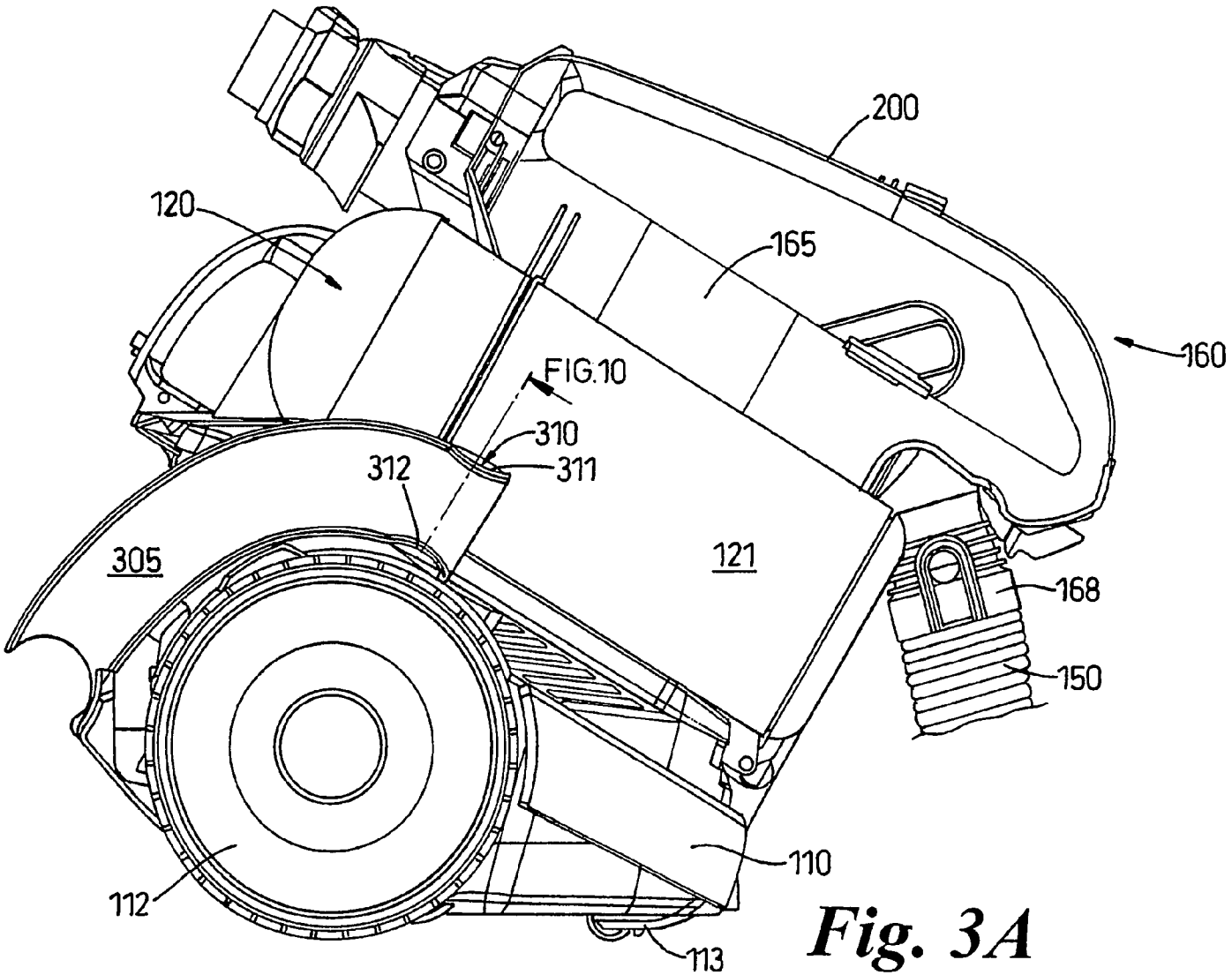
FIGS. 3A and 3B respectively show a side view and a rear view of the vacuum cleaner of FIG. 2 with the hose omitted for clarity.

As is best seen in FIG. 3A, the length of the storage tube 165 is substantially equal to the length of the part of the main body 100 against which the wand is stored. In this manner, the wand 160 does not protrude substantially beyond the main body 100 when it is fully retracted and stored on the main body 100.

Figure 7:
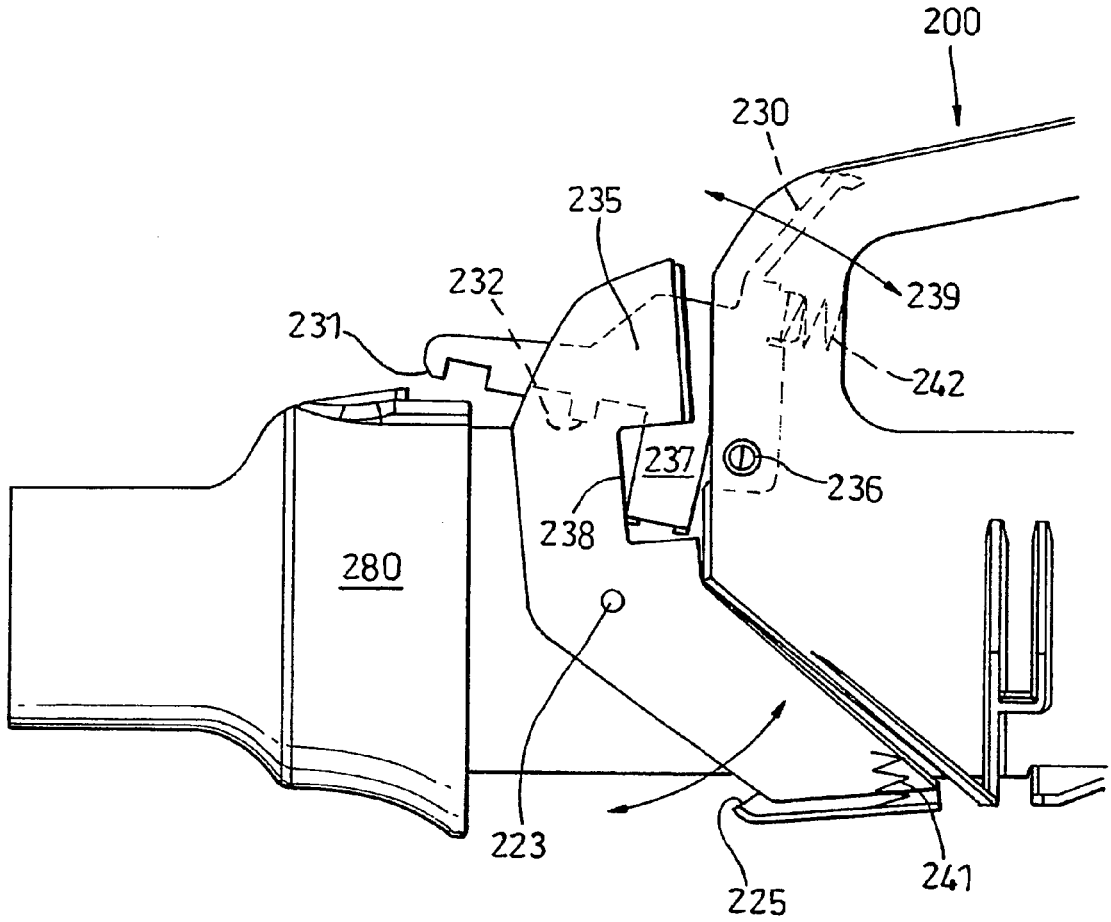
FIG. 7 is a detailed view of the catch on the wand.
Figure 8:
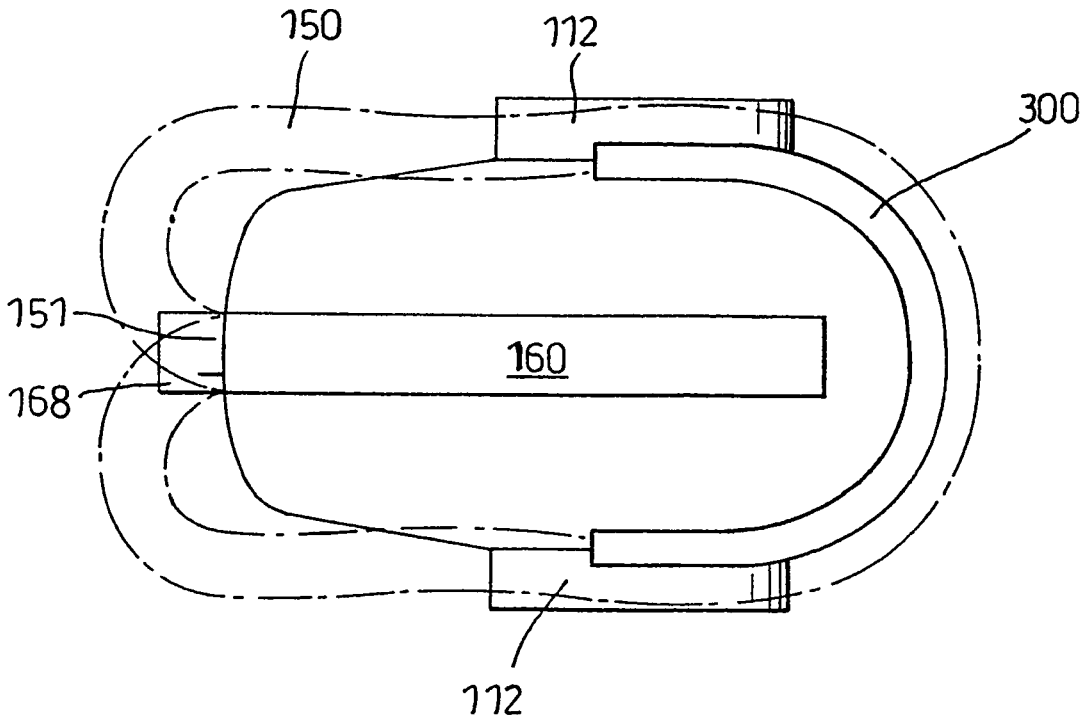
FIG. 8 is a schematic plan view of the vacuum cleaner showing the storage of the hose.

As is best seen in FIG. 6, the wand 160 is stored alongside the uppermost surface of the main body 100. FIG. 6 shows a cross-section through the wand 160 and the upper part of the separating apparatus 120 taken along the longitudinal axis of the vacuum cleaner. In this embodiment the upper surface of the separating apparatus 120, which itself is releasable from the remainder of the chassis 110 for emptying, is the part of the main body against which the wand 160 is secured. Fittings on the storage tube 165 of the wand assembly cooperate with complementary fittings on the upper surface of the separating apparatus 120 to retain the storage tube 165. The lower end of the storage tube 165 has a hooked projection 220 which extends outwardly from the tube 165. The hook 220 can locate beneath a hook 130 on the separating apparatus 120. This pair of hooks 220, 130 provides some mechanical support for the wand 160 during carrying, and also helps properly to locate the wand 160. The majority of the mechanical support is provided by a locking catch at the other end of the storage tube 165. The locking catch comprises a movable catch ring 222 with a catch face 225 and is shown in more detail in FIG. 7. The catch face 225 locates beneath another hook 135 on the upper face of the separating apparatus 120. The locking catch mechanism comprises a catch ring 222 which is pivotably mounted about the outside of the storage tube 165 about pivot point 223. The lower part of the catch ring 222 carries a catch face 225 for engaging with the main body. The catch ring is biased, by spring 241, into the locked position shown in FIGS. 5 and 6. An actuator member 235 is pivotably mounted to the storage tube 165 about pivot point 236. The actuator member 235 has a part which serves as a button 230 which can be operated by a user. The actuator member is biased by a spring 242 into the position in which it lies alongside the tube, as shown in FIGS. 2, 3A, 5 and 6.

Actuator member 235 has an arm 237 on each of its sides, the end of the arm 237 locating within a notch 238 on the catch ring 222. In use, movement of the actuator member 235, by a user pressing button 230 in clockwise direction 239, causes arm 237 to urge catch ring 222 in an anti-clockwise direction about pivot point 223 to release catch 225. Actuator member 235 also has two further locking functions which are simultaneously actuated when button 230 is pressed. Firstly, the furthest end of the actuator member has a hook 231 which can engage with the connector 280 on the end of the tube 163. When all of the tubes 161, 162, 163 have been retracted into the storage tube 165, connector 280 lies alongside the end of storage tube 165 and hook 231 can hook onto connector 280. All of the tubes 161, 162, 163 are held securely within storage tube 165 until the actuator member 235 is operated to release the hook 231. The leading edge of hook 231 has an inclined face which can be displaced by the leading edge of connector 280 as the tubes are retracted inside the storage tube 165. This allows the hook 231 automatically to ride onto, and thus retain, the cap 280 as the tubes are moved towards a stored position. Connector 280 has a cap which, in the stored position (best shown in FIG. 6) accommodates all of the securing mechanisms 400 of the tubes and thus serves to protect them from damage during storage.

Another feature of the locking mechanism is that projection 232 on the actuator member 235 can seat itself in a depression in the wall of tube 161 to lock the position of tube 161. Operating the actuator member 235 raises the projection 232 from its seated position and thus allows tube 161 to be moved. Tube 161 has a series of similar depressions 233 along its length. Projection 232 also serves to secure the tube 161 in a desired extended position with respect to the storage tube 165.

It will be appreciated that operation of the single button 230 simultaneously releases the wand 160 from the main body 100 of the vacuum cleaner, releases the end connector 280 which in turn allows the tubes 161, 162, 163 to be withdrawn from the storage tube 165, and locks tube 161 in a selected extended position.

The method of storing the vacuum cleaner will now be described. To store the wand a user brings the storage tube 165 of the wand assembly, in its fully retracted state, alongside the uppermost face of the main body 100 and engages the hooked projection 220 behind hook 130 on the main body. The user then pivots the storage tube 165 towards the main body so that the catch face 225 engages with the hook 135 on the main body. The inclined shape of the catch face 225 causes the catch ring to move away from the hook 135, against the bias of the spring, as the storage tube is pushed against the main body, and to reseat itself beneath the hook 135. At this point the wand 160 is now fully locked in position on the main body 100 and a user can then use the handle 200 on the storage tube 165 of the wand assembly to carry the vacuum cleaner.

A floor tool can be left in place on the end of the wand 160 or it can be removed and stored elsewhere on the main body 100.

To release the wand 160 from the storage position, a user operates the button 230 to move catch ring 222 and catch face 225. This releases the catch face 225 from the hook 135. The user can then pull the wand 160 away from the main body and slide the wand upwards, to remove the hooked projection 220 from the main body 100.

The position in which a user will naturally feel comfortable grasping the handle 200 to lift and carry the vacuum cleaner may well be different from the position in which the user will wish to grasp the handle 200 to operate the wand for cleaning. In this embodiment, the handle 200 extends for some distance along the length of, and parallel to, the longitudinal axis of the storage tube 165 so as to provide the user with a plurality of comfortable, longitudinally offset, positions for both carrying the vacuum cleaner and operating the wand for cleaning. Portion 205 of the handle, adjacent the end of the storage tube 165, is intended to be used to manipulate the wand during normal cleaning. Portion 205 lies at an angle to the longitudinal axis of the storage tube. This angled position, together with the position adjacent the end of the storage tube, has been found to be a comfortable position for manipulating the wand. Portion 208 of the handle is intended to be used to carry the cleaner. Control buttons for operating the vacuum cleaner can be provided in region 207. These controls can include an on/off switch, a suction power control etc. as is well known in the art. A bleed valve 209 is also located near to the part of the handle 205 which is used during cleaning. The bleed valve admits air when the trigger 209 is pulled, so as to reduce the suction force at the remote end of the wand.

The hooked projection 220 on the storage tube 165 and hook 130 on the main body both extend for some distance perpendicularly to the longitudinal axis Y-Y' of the storage tube 165. This helps to minimise any rotational movement, or wobble, of the wand about its longitudinal axis. While the hooked projection 220 and catch ring 222 adequately secure the wand to the main body 100, it is preferred to add some further features to the wand 160 and the main body for additional security. Ribs 250 extend radially outwardly from each side of the storage tube 165. Ribs 251 also extend outwardly from the upper face of the separating apparatus 120 at positions adjacent to where the storage tube 165 will lie when it is secured to the main body. The ribs serve to minimise any rotation of the storage tube 165 about its longitudinal axis Y-Y' when the tube is secured to the main body. In short, they minimise 'wobble'. A second rib 255 projects outwardly from the storage tube 165, perpendicularly to the longitudinal axis Y-Y' of the storage tube 165. This locates against a similar rib 125 on the main body 100 and serves to minimise movement of the storage tube 165 in the direction of the longitudinal axis of the tube 165.

In this embodiment, the separating apparatus 120 comprises two cylindrical chambers which lie alongside one another on the main body 100. The hooks 130, 135 are formed on the inlet duct structure which lies between the chambers. This allows the wand 160 to fit more snugly against the main body and helps to reduce the amount by which the wand 160 protrudes beyond the envelope of the main body.

The hose 150 is stored around the main body 100 of the vacuum cleaner. The hose 150 has a length which is sufficient such that, in use, the main body 100 can sit on a floor surface and the user can manipulate the wand 160 at a convenient height, without any excessive drag. In our embodiment the hose 150 has a length of around 1.5 m and a length in the range 1.3-1.8 m is typical. Conveniently, the hose 150 also has a length which is sufficient to lie once around the perimeter of the main body 100. The hose inlet 151 to the main body 100, as well as being centrally located for ease of pulling, lies below the position where the hose end 168 of the wand 160 will lie when the wand 160 is stored on the main body 100. This allows the hose 150 to form one complete perimeter of the main body 100. Hose retaining features 310 on the main body allow the hose 150 to remain attached to the main body 100 during carrying and during storage.

Figure 3B:
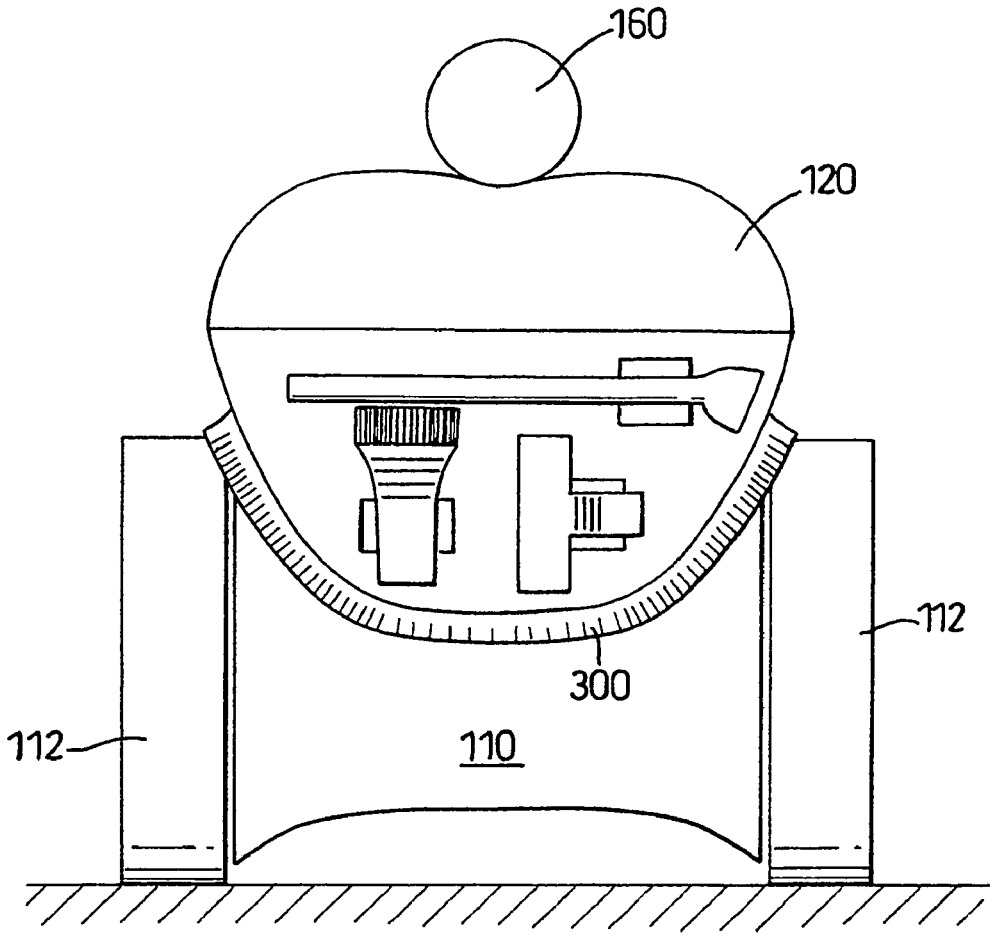

In the embodiment shown in FIGS. 2 and 3 a single continuous hose receiving channel 300 is provided along the sides and back of the periphery of the chassis 110. FIG. 2 shows the hose 150 in place in the channel 300 and FIGS. 3A and 3B show the hose removed from the channel 300. The precise means by which the hose 150 is stored on the main body 100 does not form part of the present invention and alternative hose storage means will be readily apparent to a skilled reader.

It will be clear from the foregoing description that, when the wand 160 is attached to the main body 100, the main body remains supported by its wheels 112, 113 and able to move across the floor surface to be cleaned. This is in contrast to other prior art machines which must be maneouvred into a position in which their supporting wheels or rollers are lifted away from the floor surface and the main body is commonly supported on a rear surface before the wand can be parked on the main body.

Figure 9:
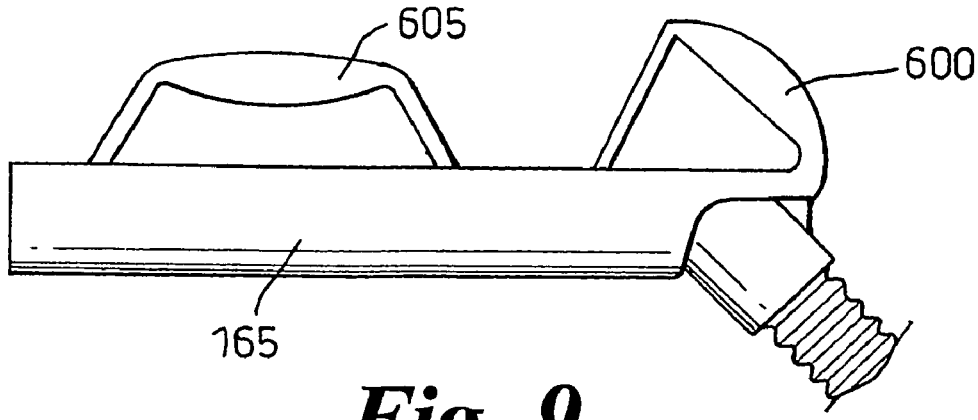
FIGS. 9 to 11 show alternative forms of the handle of the wand.

In the previously described embodiment, a single handle 200 is provided which serves for both normal cleaning and carrying. In an alternative embodiment, as shown in FIG. 9, a first handle 600 is provided for use during cleaning and a second, separate, handle 605 is provided for carrying the vacuum cleaner.

Figure 10:
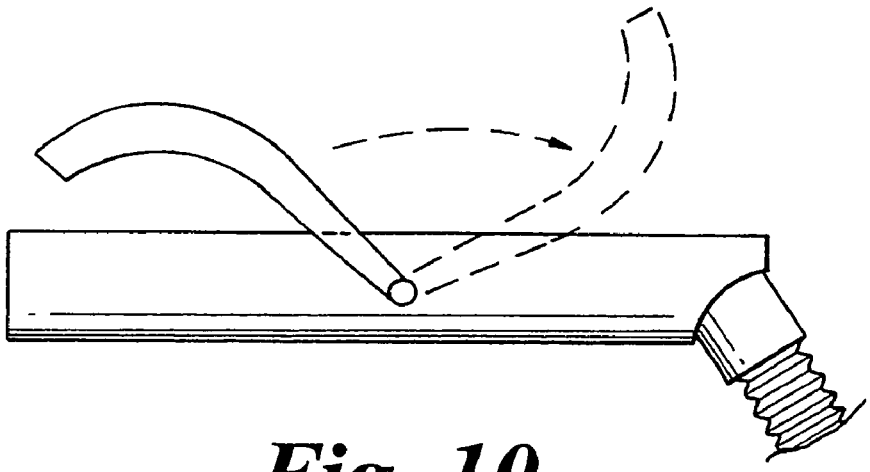

Another alternative is shown in FIG. 10 where a single handle is movable between a first position, for use in carrying the machine, and a second position for use during normal cleaning operations. The handle is pivotable between the two positions and is positively retained in each of the positions. This retention of the handle can be by a locking mechanism which is automatically operated as the handle is moved into the new position, and which is manually released, such as by a user operating a trigger, to release the handle from that position.

Figure 11:
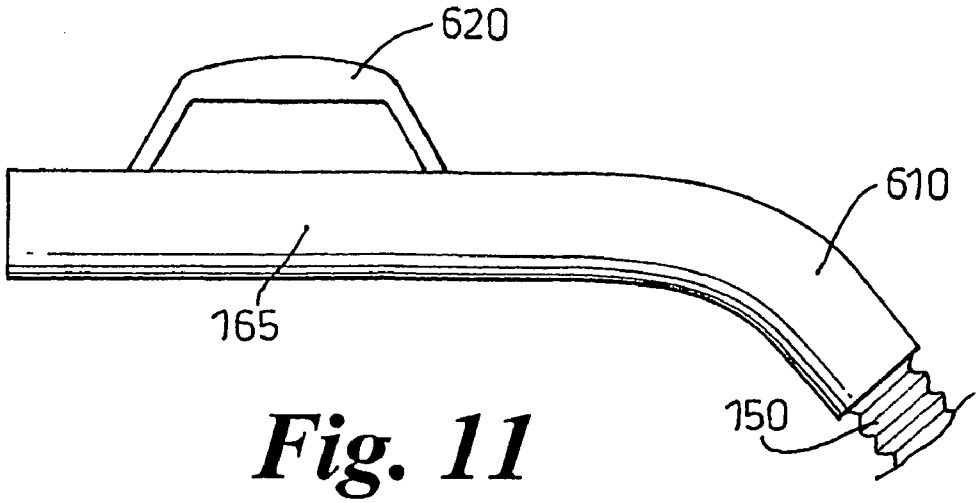

In another alternative shown in FIG. 11 there is no handle as such for manipulating the wand. Instead, an angled conduit 610 is rigidly (non-rotatably) fixed to the end of tube 165 and this angled conduit 610 serves as a part by which the user can manipulate the wand. The angled conduit 610 can be shaped to provide a comfortable gripping surface, or it can be overlaid by a material which makes the conduit more comfortable to hold. In a still further embodiment, not illustrated, the carrying handle can be omitted altogether. In this case, the main body can be provided with an alternative carrying handle.

Figure 12:
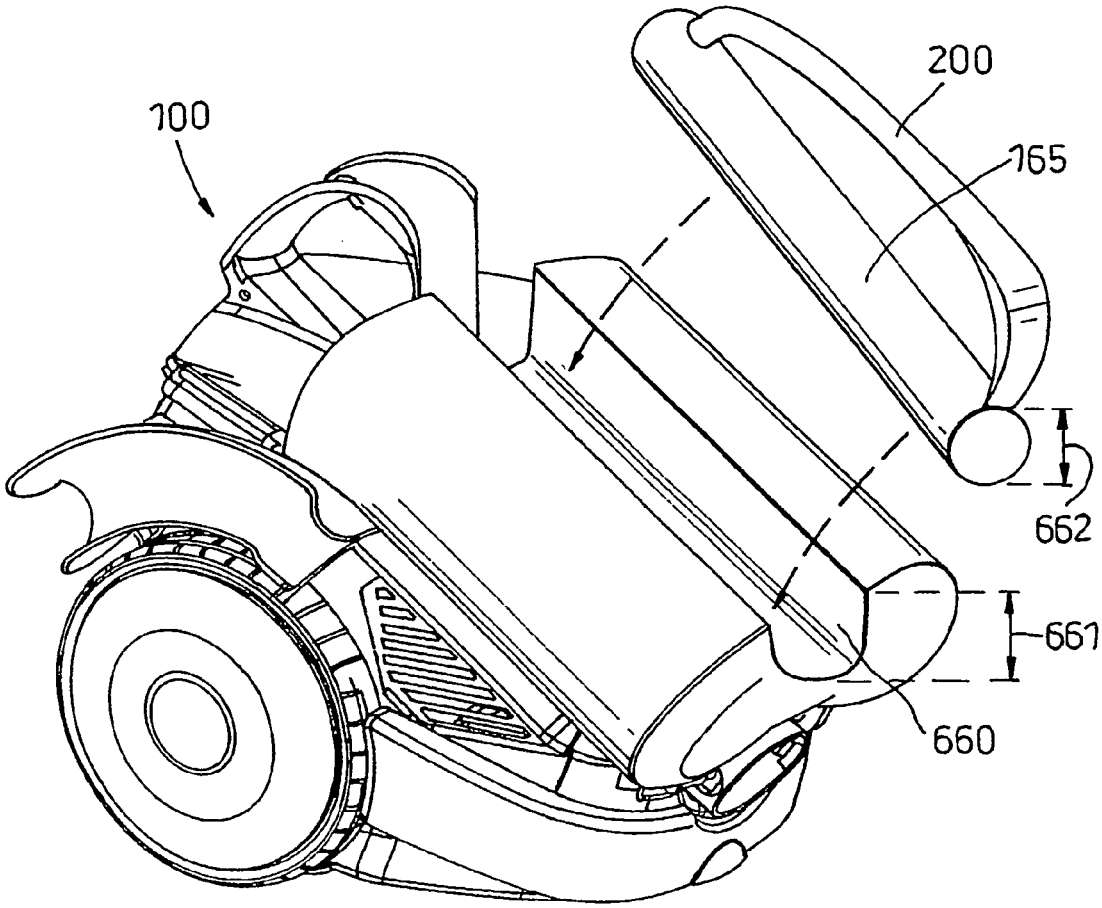
FIG. 12 shows an alternative form of the main body of the vacuum cleaner.

In the main embodiment the wand 160 is secured to the main body 100 such that a fairly large proportion of the storage tube 165 of the wand sits above the remainder of the main body 100. It is possible to increase the size of the retaining channel 660 for receiving the wand, as shown in FIG. 12. In this alternative embodiment the receiving channel 660 has a sufficient depth 661 to fully receive the storage tube 165 of the wand, with only the carry handle 200 protruding above the upper surface of the main body 100.

A second embodiment of the invention is shown in FIGS. 13A to 13D. The vacuum cleaner 500 shown in FIG. 13A to 13D has a main body 510 which includes supporting wheels 512, a front castor wheel 514 and separating apparatus 516. The separating apparatus 516 shown here operates using cyclonic principles but alternative separating apparatus can be used. Attached to the main body 510 via a connector 518 is a flexible hose 520 to which, in turn, is attached a telescopic wand 522 having a handle 524 and carrying a plurality of tools 526. The wand 522 is similar to that described above and is here shown in a fully retracted position and attached to the main body 510 for storage.

The cyclonic separating apparatus 516 includes a collecting bin 528 for collecting dirt and debris from an airflow passing through the cleaner 500. Mounted on the exterior surface of the collecting bin 528 is a slot (not shown) into which a hooked projection (not shown) mounted on the wand can be located. The slot and the hooked projection form retaining means for retaining the wand 522 on the collecting bin 528.

Figure 13A:
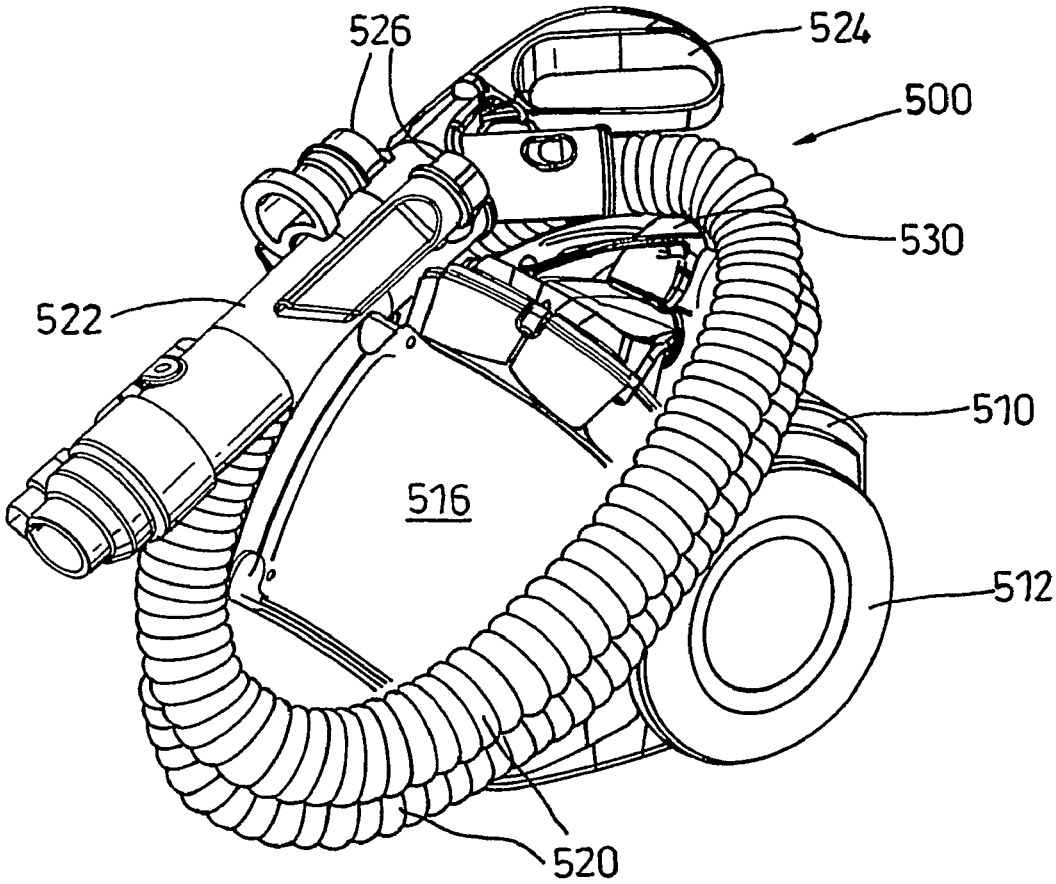
FIGS. 13A to 13D respectively show perspective, side, front, and rear views of a second embodiment of the invention in a storage position.
Figure 13B:
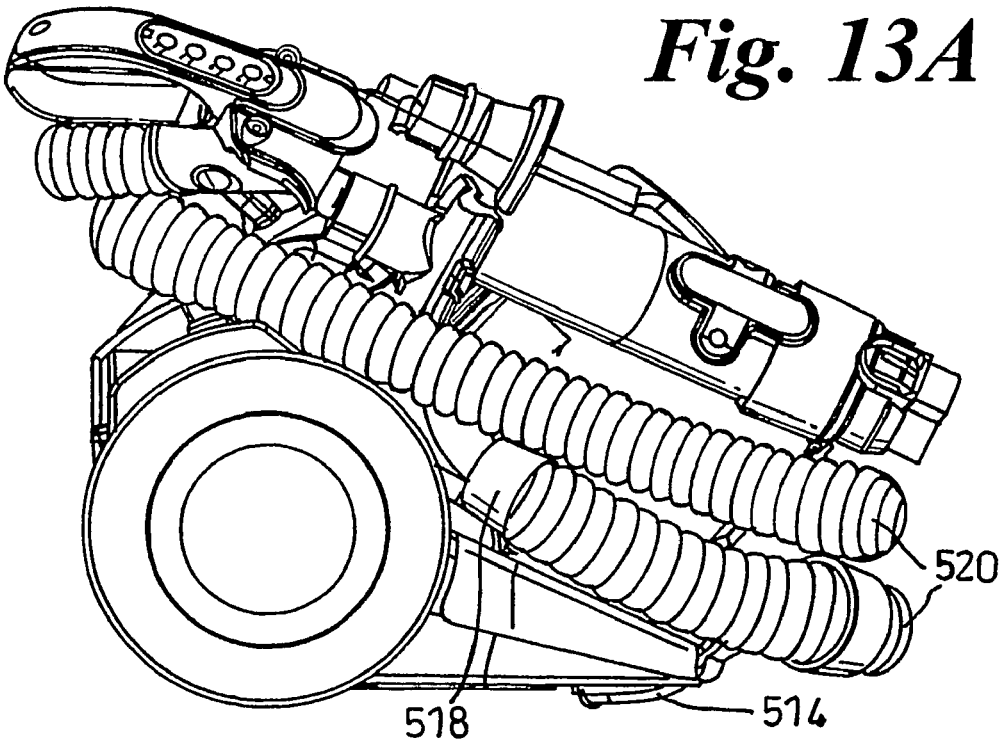
Figure 13C:
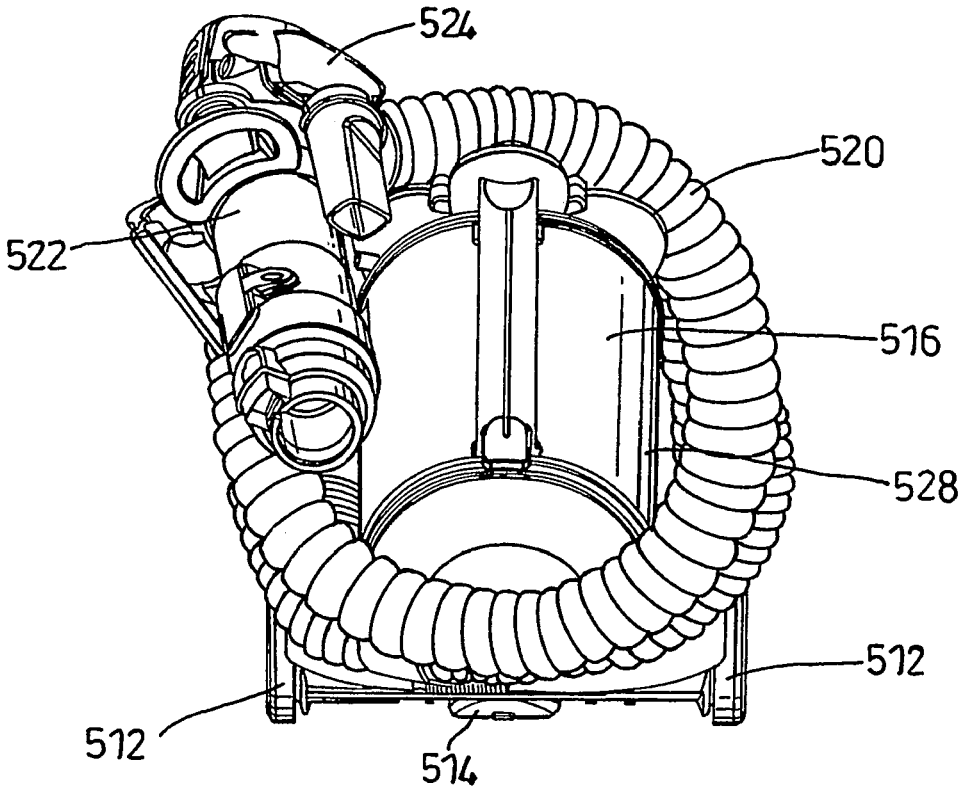
Figure 13D:
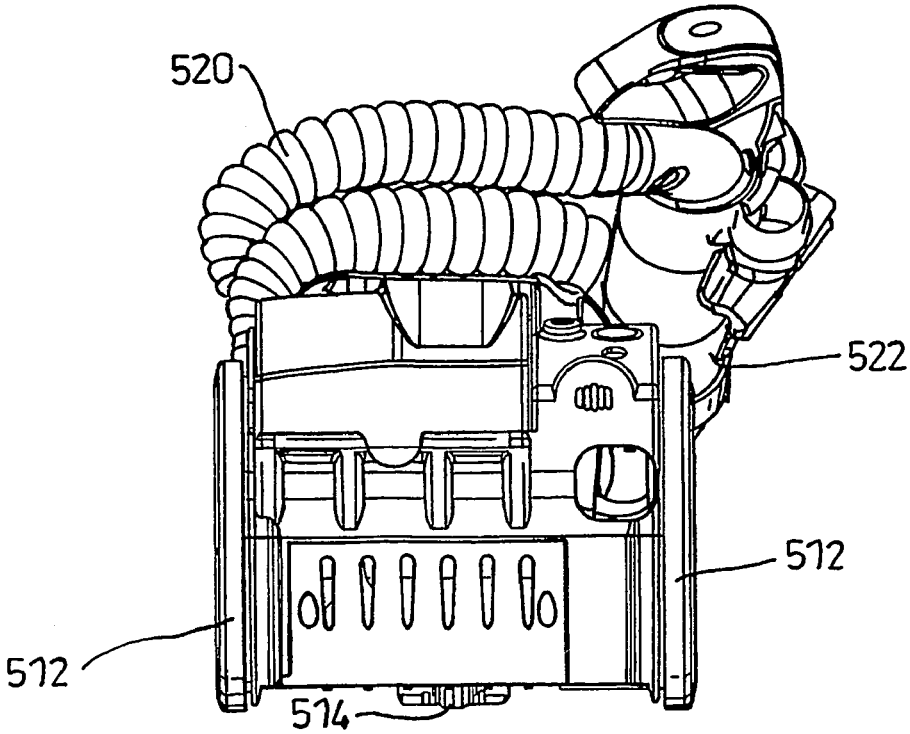

As can clearly be seen from FIGS. 13C and 13D, the wand 522 is located on an upper surface of the main body 510 but to one side thereof. The upstream end of the wand 522 is located at the rear of the main body 510 on the same side thereof. The hose 520 is connected to the main body 510 beneath a central area of the stored wand 522 and passes forwardly of the main body 510 away from the upstream end of the wand 522. The hose 520 then passes around the main body 510 through approximately one and three quarters of a turn between the connection 518 and the upstream end of the wand 522.

Unlike the embodiment described above, the hose 520 does not follow a fixed path as it is wrapped around the main body 510. Instead, hose seats (not shown) are provided at the forward end of the collecting bin 528 and on the cyclonic separating apparatus 516 behind the handle 530 located thereon. Thus, the hose 520 is held in a fixed position with respect to the main body 510 at a plurality of points along its length.

As can clearly be seen from FIGS. 13A to 13D, the hose 520 can be wrapped around the main body 510 whilst the wheels 512 and castor wheel 514 remain in contact with the surface to be cleaned. It is not necessary to re-orientate the vacuum cleaner 500 into a position in which the wheels and/or the castor wheel are lifted away from the floor. By adopting the position shown in FIGS. 13A to 13D, the vacuum cleaner 500 is able to be stored compactly and neatly into a small storage area. When the vacuum cleaner 500 is to be used, the hooked projection on the wand 522 is removed from the slot on the collecting bin and the wand 522 is then removed from the main body 510. As the wand 522 is moved away from the main body, the hose 520 is unwrapped from around the main body until it is completely free therefrom. The wand 522 is then extended to a length suitable for cleaning the floor surface on which the vacuum cleaner 500 is positioned.

It will be understood that modifications and variations will be apparent to a skilled reader. For example, the wand may be stored on the main body in any direction and the hose may be arranged to wrap around the main body more or less than one and three quarter times.

The invention claimed is:

1. A cleaning appliance of the cylinder type, comprising a main body and a hose and wand assembly, the hose and wand assembly comprising a telescopic wand movable between retracted and extended positions and a flexible hose having a first end connected to the main body and a second end connected to the wand, wherein the main body comprises hose seats located at forward and rearward positions of the main body, the hose seats defining recesses within the main body for holding the hose in a fixed position with respect to the main body at a plurality of points along the length of the hose when the hose is made to pass at least once around the main body, and wherein the wand and the main body incorporate a retainer that releasably attaches the wand to the main body when the wand is in the retracted position and the hose is held in the hose seats.

2. The cleaning appliance as claimed in claim 1, wherein the hose passes more than once around the main body when the wand is attached thereto.

3. The cleaning appliance as claimed in claim 1, wherein the hose follows a predetermined path around the main body when the wand is attached thereto.

4. The cleaning appliance as claimed in claim 1, wherein the main body comprises a cyclonic separator having a collecting bin for collecting dirt and debris and the wand is releasably attachable to the collecting bin.

5. A cleaning appliance of the cylinder type comprising a main body and a hose and wand assembly, the main body comprising two generally cylindrical containers lying parallel next to one another, and the hose and wand assembly comprising a telescopic wand movable between retracted and extended positions and having a handle, and a flexible hose having a first end connected to the main body and a second end connected to the wand, wherein an upper surface of the main body comprises a channel lying between the containers for receiving the wand, and the wand and the main body incorporate a locking mechanism that releasably locks the wand to the upper surface of the main body when the wand is in the retracted position so that the cleaning appliance can be carried by the handle.

6. The cleaning appliance according to claim 5, wherein the locking mechanism is located in the channel.

7. The cleaning appliance as claimed in claim 5 or 6, wherein the channel has a sufficient depth to allow the wand to lie substantially flush with the upper surface of the main body when the wand is received in the channel.

8. The cleaning appliance as claimed in claim 5, wherein the handle may also be used by the user to manipulate the hose and wand assembly during normal use.

9. The cleaning appliance as claimed in claim 5, wherein the handle extends in a direction which is substantially parallel to the longitudinal axis of the wand so as to provide a plurality of longitudinally offset positions for lifting the main body and for manipulating the hose and wand assembly.

10. The cleaning appliance as claimed in claim 1 or 5, wherein the wand may be attached to the main body when the main body is oriented for normal use.

11. The cleaning appliance as claimed in claim 10, wherein the main body has wheels or rollers arranged so as to allow the main body to move across a surface to be cleaned and the wheels or rollers remain in contact with the surface when the wand is attached to the main body.

12. The cleaning appliance as claimed in claim 1 or 5, wherein a substantial part of the length of the wand, in the retracted position, lies alongside the main body when the wand is attached thereto.

13. The cleaning appliance as claimed in claim 12, wherein substantially all of the wand, in the retracted position, lies alongside the main body when the wand is attached thereto.

14. The cleaning appliance as claimed in claim 1 or 5, further comprising a rotation preventer that prevents rotation of the wand when it is attached to the main body.

15. The cleaning appliance as claimed in claim 14, wherein the rotation preventer comprises a first part, mounted on the main body, and a second part mounted on the wand, each part having a face which extends radially with respect to the longitudinal axis of the wand.

16. The cleaning appliance as claimed in claim 1 or 5, wherein the hose and wand assembly carries a release member for releasing the wand from the main body.

17. The cleaning appliance as claimed in claim 16, wherein the wand comprises a lock configured to lock the wand in the retracted position and actuation of the release member also releases the lock.

18. The cleaning appliance as claimed in claim 1 or 5, wherein the first and second ends of the hose are located adjacent one another when the wand is attached to the main body.

19. The cleaning appliance as claimed in claim 1 or 5, wherein the first and second ends of the hose are circumferentially spaced apart from one another when the wand is attached to the main body.

20. The cleaning appliance as claimed in claim 1 or 5, wherein the cleaning appliance takes the form of a vacuum cleaner.

21. The cleaning appliance as claimed in claim 1, wherein the main body comprises a separating apparatus removably mounted on a chassis and the retainer releasably attaches the wand to the separating apparatus.

22. A cleaning appliance of the cylinder type, comprising a main body and a hose and wand assembly, the main body comprising a hose receiving channel provided on multiple sides of the main body, the hose and wand assembly comprising a telescopic wand movable between retracted and extended positions and a flexible hose having a first end connected to the main body and a second end connected to the wand, wherein the wand and main body incorporate a retainer that releasably attaches the wand to the main body when the wand is in the retracted position and the hose passes at least once around the main body and is received by the hose receiving channel.

23. The cleaning appliance as claimed in claim 22, wherein the main body comprises a separating apparatus removably mounted on a chassis and the retainer releasably attaches the wand to the separating apparatus.

24. The cleaning appliance as claimed in claim 22, wherein the hose follows a predetermined path around the main body when the wand is attached thereto.

25. The cleaning appliance as claimed in claim 22, wherein the main body comprises a cyclonic separator having a collecting bin for collecting dirt and debris and the wand is releasably attachable to the collecting bin.

26. The cleaning appliance as claimed in claim 22, wherein the wand may be attached to the main body when the main body is oriented for normal use.

27. The cleaning appliance as claimed in claim 22, wherein a substantial part of the length of the wand, in the retracted position, lies alongside the main body when the wand is attached thereto.

28. The cleaning appliance as claimed in claim 22, further comprising a rotation preventer that prevents rotation of the wand when the wand is attached to the main body.

29. The cleaning appliance as claimed in claim 22, wherein the hose and wand assembly carries a release member for releasing the wand from the main body.

30. The cleaning appliance as claimed in claim 22, wherein the first and second ends of the hose are located adjacent one another when the wand is attached to the main body.

31. The cleaning appliance as claimed in claim 22, wherein first and second ends of the hose are circumferentially spaced apart from one another when the wand is attached to the main body.

32. The cleaning appliance as claimed in claim 22, wherein the cleaning appliance takes the form of a vacuum cleaner.

33. The cleaning appliance as claimed in claim 22, wherein the hose receiving channel is a single continuous channel.

34. A cleaning appliance of the cylinder type, comprising a main body and a hose and wand assembly, the main body comprising hose retaining features provided on multiple sides of the main body, and the hose and wand assembly comprising a telescopic wand movable between retracted and extended positions and a flexible hose having a first end connected to the main body and a second end connected to the wand, wherein the wand and the main body incorporate a retainer that releasably attaches the wand to the main body when the wand is in the retracted position and the hose passes at least once around the main body and is retained by the hose retaining features.

* * * * *